US005800131A

United States Patent [19]

Lehmann et al.

[11] Patent Number: 5,800,131

[45] Date of Patent: Sep. 1, 1998

[54] PROCESS FOR REGULATING THE CAPACITY OF LUBRICANT PUMPS AND LUBRICANT PUMP THEREFOR

[75] Inventors: Uwe Lehmann, Wörrstadt; Bodo Stich, Wiesbaden; Maik Wilhelm, Trebur, all of Germany

[73] Assignee: Mercedes-Benz Aktiengesellschaft, Stuttgart, Germany

[21] Appl. No.: 500,937

[22] PCT Filed: Jan. 27, 1994

[86] PCT No.: PCT/DE94/00087

§ 371 Date: Jul. 26, 1995

§ 102(e) Date: Jul. 26, 1995

[87] PCT Pub. No.: WO94/17308

PCT Pub. Date: Aug. 4, 1994

[30] Foreign Application Priority Data

Jan. 30, 1993 [DE] Germany ..... 43 02 610.9

[51] Int. Cl.[6] ..... F04B 49/00

[52] U.S. Cl. ..... 417/270

[58] Field of Search ..... 417/220

[56] References Cited

U.S. PATENT DOCUMENTS

| | | | |
|---|---|---|---|
| 3,456,593 | 7/1969 | Rosaen | 417/220 X |
| 4,259,039 | 3/1981 | Arnold | 417/220 |
| 4,538,974 | 9/1985 | Stich et al. | 417/220 X |
| 4,693,081 | 9/1987 | Nakamura et al. | 417/220 X |

FOREIGN PATENT DOCUMENTS 59-136592 8/1984 Japan .

OTHER PUBLICATIONS

Power Input and Storage, U.S. Publication "Machine Design" Jun. 1990, pp. 554–586.

Technical Publication No. 1, Dea and Texaco Verkauf GmbH, "Schmierung", 1970.

*Primary Examiner*—Charles G. Freay

*Attorney, Agent, or Firm*—Herbert Dubno

[57] ABSTRACT

A vane pump and a process for operating it in which an eccentric ring against which the vanes ride is shifted in response to a temperature sensing element which bears upon the ring against the force of a spring acting thereon counter to the temperature sensing element.

1 Claim, 5 Drawing Sheets

PROCESS FOR REGULATING THE CAPACITY OF LUBRICANT PUMPS AND LUBRICANT PUMP THEREFOR

CROSS REFERENCE TO RELATED APPLICATIONS

This application is a national phase of PCT/DE 94/00087 filed 27 Jan. 1994 and based, in turn, on German national application P 43 02 610.9 of 30 Jan. 1993 under the International Convention.

FIELD OF THE INVENTION

The invention relates to a process for the regulation of the pumping capacity of lubricant pumps in which the pumping capacity is regulated by the pressure at the pump outlet or at a consumer site, such that when the pressure increases the pumping capacity is effectively reduced. The present invention relates also to a lubricant pump which may be regulated and comprises a regulating device by which the pumping capacity is effectively reduced in order to limit the lubricant flow.

BACKGROUND OF THE INVENTION

A process and a pump, specifically a vane pump, with pressure regulation, are known from German Offenlegungsschrift No. 40 11 679.

The pressure at the discharge side of a pump of this type can be caused to act on a regulating piston on which a compression spring acts from the opposite side directly or indirectly. The piston acts on the displaceable ring of the vane pump and influences thereby its eccentricity and the lubricant flow. The pump and the regulating device are so designed that when the pressure at the discharge side of the pump increases, the piston displaces the displaceable ring in the direction of smaller eccentricity so that by the reduction of the lubricant flow the pressure at the discharge side of the pump is reduced. By the use of suitable compression springs and geometries of the regulating device the regulating characteristics of such a pump may be varied within wide limits.

The application of the present invention is, however, not limited to vane pumps. The invention may be used particularly for all pumps which can be regulated, particularly pumps using only a so-called loss control, i.e. in which, when a predetermined pressure is exceeded, excessive lubricant is directed through a bypass around consumer sites while only the lubricant flow (effective lubricant flow) pumped through the system is reduced but not the total quantity pumped. Naturally, rather than using such systems it is preferable to use controllable pumps whose pumping capacity or lubricant flow may be directly influenced and not only their effective lubricant flow.

The term "effective lubricant flow" is intended to mean that volume of he lubricant which is pumped under pressure per unit time through the consumer sites, the corresponding supply and discharge lines and possibly auxiliary, upstream units, such as oil filters. Oil, which is pumped, for instance through bypasses, from and back to a pump reservoir is not considered to be part of the effective lubricant flow. Also draining off oil through bypasses reduces the pressure at the discharge side of the pump and in the whole system so that no energy saving can be achieved. A significant reduction of energy is achieved only when the volume pumped by the pump is from the outset adapted to the demand as is the case with controllable vane pumps or constant-displacement pumps with multi-stage control systems.

Such lubricant pumps are used particularly to supply lubricant to lubrication points in internal combustion engines, particularly for motor vehicles.

The demand for lubricant or the minimum demand of an internal combustion engine depends however on a number of different factors. A significant factor is the working temperature of the engine and/or of the relevant lubrication points and also of the lubricant. When it is cold, oil, used generally as a lubricant, has a high viscosity and may be forced only with difficulties through narrow spaces at the lubrication points. At the same time also the demand on lubricant of a cold internal combustion engine is not very high because the parts moving with respect to each other have in a cold state generally a smaller clearance from each other and the viscosity of the oil is high so that less oil may be forced through.

In view of this, the effective pumping capacity of the lubricant pump was in the past so adjusted that at the discharge side of the pump the predetermined maximum pressure was not exceeded. It will be understood that when the engine is cold, because the oil is highly viscous, when the engine and the lubricant pump directly coupled thereto are started, the pressure at the discharge side of the lubricant pump initially raises relatively steeply because the resistance to flow of the oil through the lubrication points is relatively high. There is a danger that individual components within the lubricating system, such as an oil filter, may be damaged or destroyed by the excessively high pressure. For this reason a pressure limitation is usually provided in regulation which either drains off the excessively pumped lubricant through a bypass or directly limits the lubricant flow through the pump, so that at the predetermined limiting pressure the pumped lubricant may be pumped through the lubricating system. With increasing temperature the resistance to flow in the lubricating system drops, so that the lubricant flow may be gradually increased. The pressure can then drop somewhat below the limiting pressure, whereby the effective lubricant flow or the pumping capacity are correspondingly increased. The control characteristics of the known controllable pumps is generally so adjusted that the output pressure remains nearly constant and only the lubricant flow varies in dependence on the resistance to flow in the lubricating system.

It was believed in the past that by such control the varying demand on lubrication of an internal combustion engine in cold and warm state was sufficiently taken into account. For reasons of cost, lubricant oil pumps for internal combustion engines are in general so designed, that they safely meet, with a certain reserve, the oil requirement of the engine at the maximum operating temperature and with oil of the lowest permissible viscosity (=critical lubricating conditions) whatever the engine speed. The decisive point for lubricant flow is the oil requirement of the engine when it is idling and is hot and the oil has a correspondingly low viscosity. Even at this stage the pump must provide a certain minimum lubricant flow and therefore a certain minimum oil pressure, while the pump shaft is, in general, connected directly to the engine as has already been mentioned.

Another critical state is high engine speed when the engine is hot. In this case a much higher oil pressure is needed than in the case of low engine speed. The pressure regulation known per se is therefore adjusted with a corresponding safety reserve to this working situation.

Because in the state of the art the pressure is maintained constantly at this high level, below which it drops only exceptionally at high temperatures and simultaneously low engine speed, it is clear that across a wide range of normal working conditions a much higher amount of oil is pumped through the system and a much higher oil pressure is maintained than corresponds to the actual need (minimum oil need or minimum oil pressure). If the pressure is held at a constant level, for varying temperatures there are so-called oil requirement curves of internal combustion engines in dependence on engine speed.

The volumetric efficiency of oil pumps generally increases with decreasing temperature, this being caused by smaller losses due to leakage. At the same time the demand of the engine for lubricating oil decreases with falling temperature. It follows that at temperatures which are lower than the maximum working temperatures of oil pumps in any working condition, i.e. at any engine revolutions, more oil is supplied than the engine needs. The flow rate values of the engine represented by the aforementioned curves do not show what quantity of oil the engine actually needs at the given engine speed and temperature as the minimum quantity of lubricant, but shows only how much lubricant it takes at constant pressure and the given temperatures and engine speed. Pumping under pressure lubricant which is not needed in this amount requires wasted energy.

OBJECT OF THE INVENTION

The object of the present invention is to provide a process for controlling lubricant pumps and a corresponding lubricant pump which has an altogether smaller requirement of energy.

SUMMARY OF THE INVENTION

This object is achieved in that additional regulation or limitation of the effective lubricant flow, which is independent of possible pressure-dependent regulation, is carried out by the sensing of temperature and/or engine speed.

It is further provided in the process according to the invention that the lubricant flow, which is by temperature control, increases with temperature.

A regulating device can be provided which comprises a sensor of temperature and/or a sensor of engine speed and also a regulating member which reduces the effective lubricant flow in dependence on temperature and/or engine speed independently of possible pressure regulation.

In the sense of the present invention the words "independently of possible pressure regulation" do not necessarily mean that the regulation of temperature or engine speed has no influence on the pressure regulation or remains uninfluenced by possible pressure regulation in any working condition, but mean only that temperature and/or engine speed are used as additional independent parameters for the adjustment of an oil flow and a resulting oil pressure.

The oil flow is thereby adjusted not only so that a predetermined maximum pressure at the consumer sites, or possible units which might be situated upstream or downstream, is not exceeded, but a further limitation of the oil flow may be regulated in dependence on the temperature and/or engine speed, so that the pressure at the discharge side of the pump, or at the pressure measuring points provided for the pump regulation, remains still significantly below the predetermined maximum pressure, when the system (for instance at a temperature measured at suitable points or in a region of low engine speed) has a correspondingly small demand on lubricant so that the lubricant need not be supplied at the higher pressure, which is needed in particularly critical working conditions, or in the case of a correspondingly smaller quantity.

In a preferred embodiment of the invention the lubricant pump according to the invention is a controllable vane pump. Controllable vane pumps have the advantage that in them the lubricant flow may be relatively simply adjusted by mechanical displacement of their displaceable ring. This has the advantage that the shaft of the pump may be directly connected to the engine and in spite of this a regulation of the lubricant flow is possible which is independent of the engine. Naturally, also other regulating devices may be used, in which, for instance, the revolutions at which a lubrication pumps is driven are controlled by regulating members operating in dependence on pressure and/or temperature. This naturally requires an independent drive for the pump.

In a preferred embodiment of the invention, a wedge with a thermostat, such as a bimetallic strip, is used as the regulating member, and one side of the wedge engages with the displaceable ring, so that when the wedge is displaced also the displaceable ring is displaced.

As part of the regulating member or as the regulating member itself, for instance, a bimetallic strip can be used. Such a bimetallic strip may also be additionally so designed and arranged that, if desired, it may be in direct contact with the displaceable ring and displace it according to the temperature of the bimetallic strip.

Also other measuring sensors and control methods are known to a person skilled in the art. Measuring and control can be performed, for instance, by electric elements, such as temperature-dependent electric components, particularly resistors, which are measured in a control circuit and give, as an output quantity, an electrical signal which causes displacement of a regulating member corresponding to the electric signal.

A special case of such a system is, for instance, a stepped piston on whose one sub-area acts, for pressure regulation, the output pressure of the pump or the pressure at a consumer site. On a further area of the stepped piston may act pressure in dependence on the engine speed or temperature via a temperature or speed-controlled valve. When the temperature or engine speeds are low, the valve may be for instance open, so that also on the second sub-area of the stepped piston acts pressure, which results in stronger displacement of the stepped piston so that the displaceable ring is so adjusted, that a smaller lubricant flow and with it a relatively small working pressure are set. In the case of a higher temperature of revolutions the valve is closed via the temperature or revolution control, so that pressure acts only on a smaller sub-area of the piston, so that the pump is adjusted for a higher output pressure and higher pumping capacity.

The corresponding regulation and control elements should be as simple as possible so as not to make the pump much more complex. This applies primarily for the use of the pump in standard situations, e.g. for internal combustion engines. In the case of engines or, in general, systems requiring lubrication which are subject to very strongly changing working conditions, also a more expensive temperature control of the lubricant quantity may be used and justified, as long as this additional expense is compensated by a correspondingly high energy saving and reduction of the pumped quantity of lubricant enabled thereby.

BRIEF DESCRIPTION OF THE DRAWING

Further advantages, features and applications of the present invention will be apparent form the following description, reference being made to the accompanying drawing in which.

SPECIFIC DESCRIPTION

Figure 1:
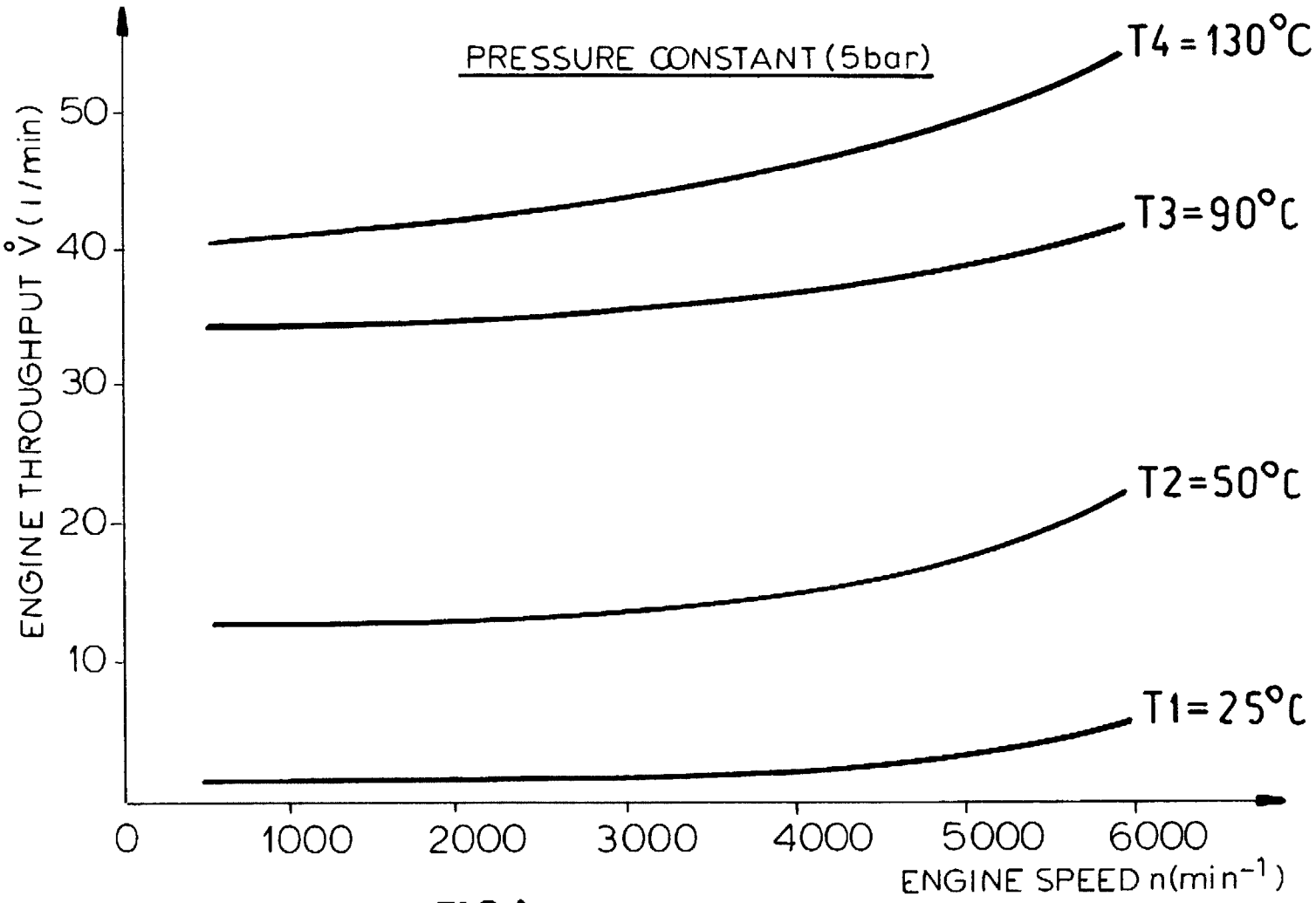
FIG. 1 is a set of graphs which shows flow rates of an engine in dependence on the engine speeds of an engine at the different temperatures.

In FIG. 1 are shown four so-called engine flow rates of an engine at temperatures T1=25° C., T2=50° C., T3=90° C. and T4=130° C. Plotted is the oil flow or the amount consumed by the engine in liters per minute against the speed of the engine. From the shape of the individual curves may be seen that the flow rate of lubricant at constant pressure increases with increasing engine speed while, however, this increase is not proportional to revolutions.

It can be seen at the same time from the different shapes of the curves for various temperatures that for a given engine speed the engine needs at a lower temperature much less oil than at a high temperature.

In the case of the flow rates through the engine shown in FIG. 1, the pressure in the supply lines to the engine has always the same value (e.g. 5 bar).

This pressure is so controlled that in a critical condition, e.g. during the highest demand for oil, i.e. at the highest temperature and the highest engine speed, the oil demand of the engine is still satisfied with oil of the lowest permissible viscosity.

Figure 2:
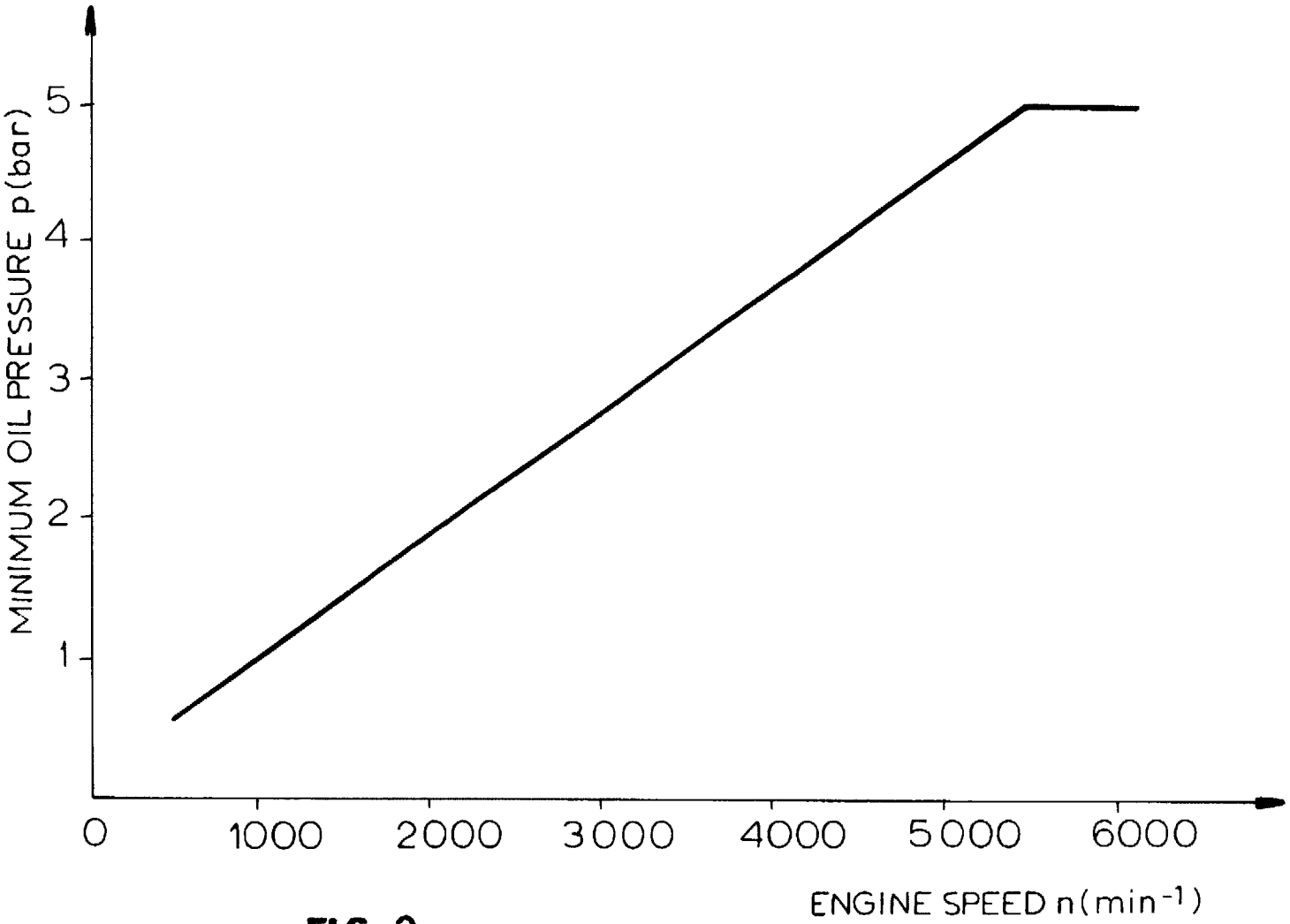
FIG. 2 is a graph which shows the necessary minimum pressure of oil of an engine in dependence on revolutions.

It is apparent from FIG. 2 that the minimum pressure of oil increases in the lubricating system typically with the engine speed up to a value of about 5 bar. Naturally the exact values and the shape of the curves depend strongly on the type and size of the engine and the specific design of the lubricating system, so that the given figures should be understood only as examples and should not impose any limitation of the subject-matter of the invention. Pumps according to the state of the art are generally so designed that they maintain the pressure, independently of the temperature and substantially also independently of the engine speed, always on the value which was provided for the relevant lubricating system as the minimum pressure of oil in critical working conditions (e.g. the mentioned value of 5 bar). The typically used vane pumps produce also readily much higher discharge pressures. Only pressure limitations have therefore been used in practice which keep the pressure constant, while only a limiting pressure was selected which was, with a certain safety reserve, above the highest minimum pressure of oil in critical working conditions and was achieved at relatively low engine speed.

The maximum pressure provided by the pressure limitation is very quickly achieved particularly at low temperatures and an uncontrolled pump pumps in such a case mainly in a low range of engine speed substantially more oil than the engine requires.

Figure 3:
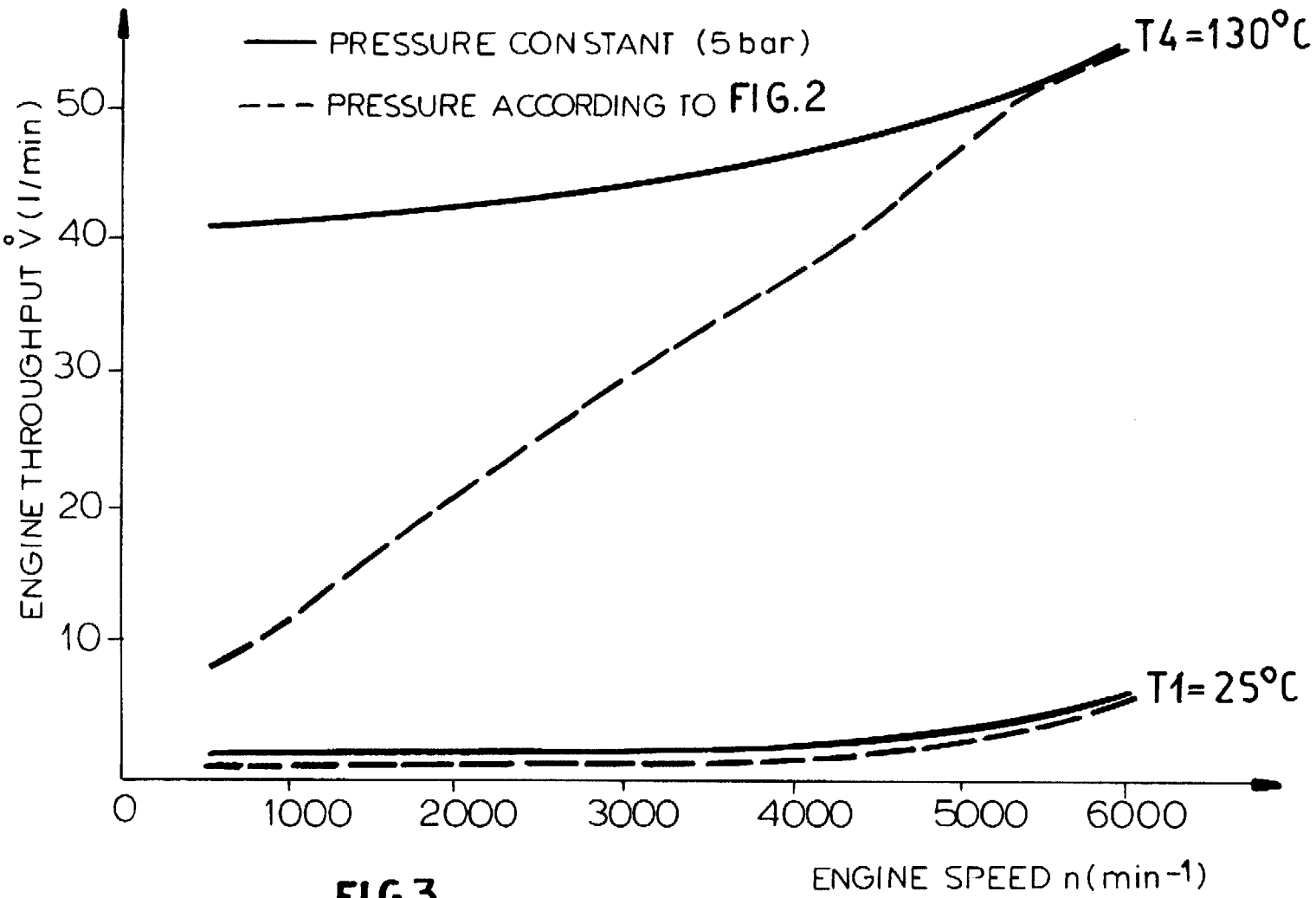
FIG. 3 is a set of graphs which show the engine flow rates in connection with the cure of minimum pressure according to FIG. 2.

Conventionally controlled pumps supply always only as much oil as corresponds to the adjusted maximum pressure but this pressure is also the required minimum pressure of oil only at high revolutions. In all other working conditions the pressure and the lubricant flow may be simply smaller. Particularly for low engine speeds and low working temperatures there is a considerable potential for savings in that, for instance, via a control dependent on engine speed and temperature, the pressure of the engine oil is regulated clearly below the limiting value of conventional systems to which the regulation system is adjusted so as to protect components sensitive to pressure. Pumped lubricant flows or flow rates thorough the engine result, which are shown in dashed lines in FIG. 3, and it can be seen that even in the case of high working temperatures and low engine speed considerable saving potential is still available. Such working conditions exist often, for instance, in internal combustion engines in town traffic. By the reduced quantity of oil which is supplied to the engine in these working conditions, which is, however, fully sufficient for the requirements of lubrication, the energy requirement of the lubricating pump and therefore also the total energy requirement of the engine are reduced. One of the significant aims of the present invention is thereby achieved. By the combination of pressure regulation and temperature regulation only so much energy is needed for the flow of oil as is necessary to ensure a sufficient supply of the engine with oil. Examples of technical applications in practice are illustrated in FIGS. 4 to 7.

Figure 4:
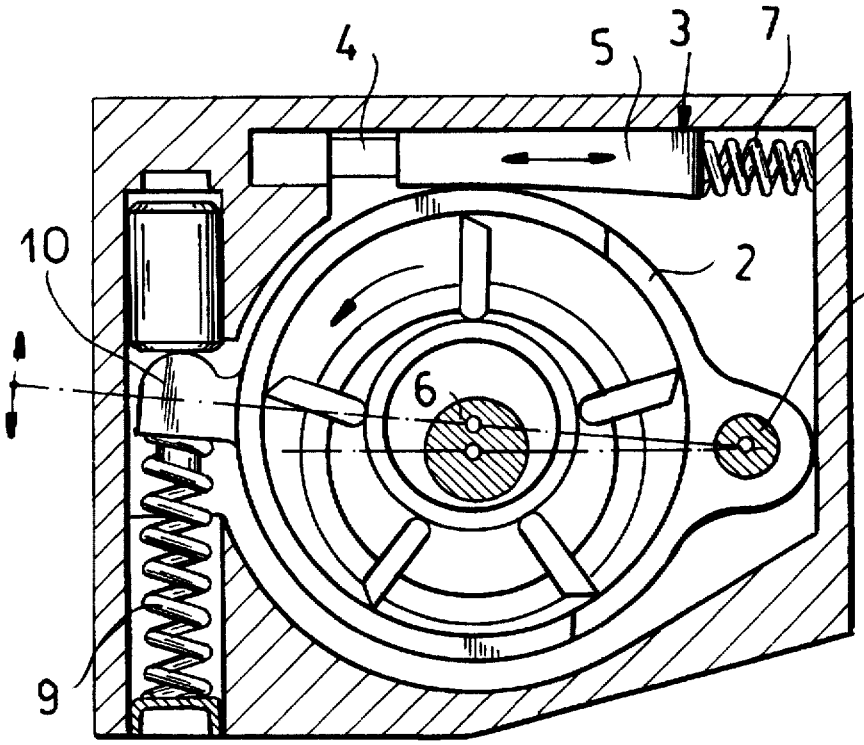
FIG. 4 is a cross sectional view which shows the principle of a temperature-dependent control of the displaceable ring of a vane pump by means of a wedge.

In FIG. 4 is diagrammatically illustrated a vane pump 1 comprising a displaceable ring 2. Also diagrammatically illustrated is a temperature controller for the eccentricity of the displaceable ring 2 with respect to the pump shaft 6. The temperature controller 3 comprises a temperature sensor or a temperature sensing element 4, a wedge 5 and a spring 7 which are arranged in a row next to the displaceable ring. The temperature controller 3 is situated, for instance, inside a casing of the pump and is in direct contact with the pumped oil which flows through radial holes into the displaceable ring and may flow out through axial holes in the casing. The temperature sensitive element 4 is thereby maintained substantially at the temperature of the lubricant. In the simplest case the element 4 could be, for instance, an element whose thermal expansion within the temperature range of interest is relatively high (the element 4 could be, for instance, a volume of gas). If the temperature increased, the element 4 would expand and move thereby the wedge 5 against the action of the spring 7 to the right, so that the displaceable ring 2 could be swung about the pivot 8 upwards. For this purpose is provided, for instance, a compression spring 9 which acts on an adjusting projection 10 of the displaceable ring 2 and pushes the latter upwards in contact with the side of the wedge. So as to obtain the desired adjustment characteristic of the pump, i.e. increase of the lubricant flow with increasing temperature, the displaceable ring 2 is so arranged relative to the pump shaft 6, that the eccentricity of the displaceable ring with respect to the pump shaft 6 increases with the displacement of the ring 2 upwards about the pivot 8, i.e. when the wedge 5 moves to the right. Conversely, with decreasing temperature the displaceable ring 2 is forced by the side of the wedge 5 downwards against the action of the spring 9, when the temperature of the lubricant system decreases or is lower, while the wedge 5 moves from the right to the left. Suitable guides prevent the wedge 5 from moving transversely to its path of regulation.

Figure 5:
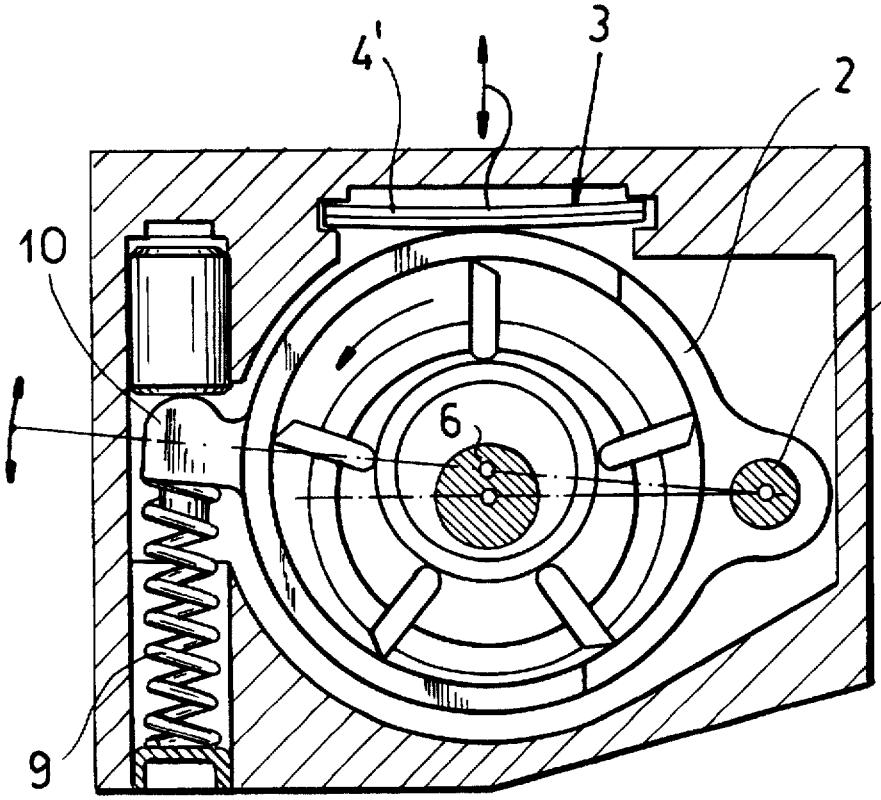
FIG. 5 is a cross sectional view which shows temperature-dependent control of the displaceable ring by means of a bimetallic element.

The vane pump shown in FIG. 5 may be substantially identical with the vane pump shown in FIG. 4, except that the regulating device 3 is replaced by a leaf spring or a bimetallic strip 4' which has, at the same time, the function of a temperature sensor and a regulating member. With increasing temperature the two metal strips of the bimetallic strip 4' (which are firmly connected to each other) expand differently, so that, according to the relative arrangement of the two metallic elements, the curvature of the leaf spring 4' increases or decreases and the eccentricity of the displaceable ring 2 with respect to pump shaft is correspondingly reduced or increased.

Figure 6:
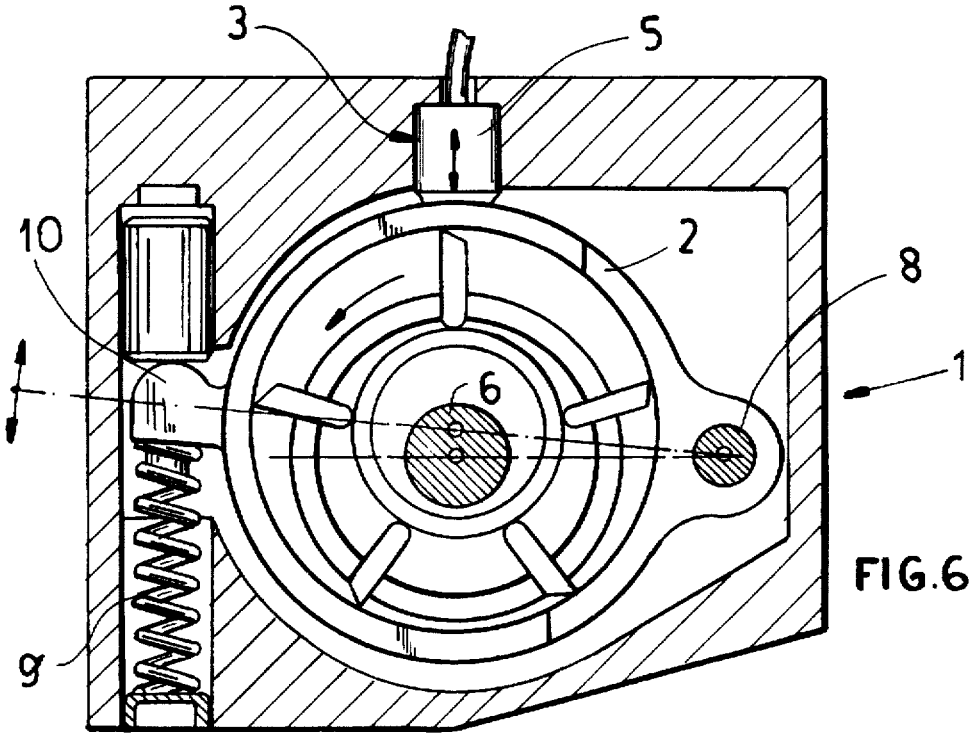
FIG. 6 is a cross sectional view which shows temperature-dependent control of the displaceable ring by means of an electrically controlled element.

FIG. 6 shows an electrically controllable temperature regulator acting as a regulating member 5, while the temperature sensed by a temperature sensor is measured and converted into a corresponding control signal which displaces the displaceable ring in the desired direction, namely such that its eccentricity increases with increasing temperature of the lubricant. The remaining details of the pretensioning of the displaceable ring 2 by the spring 9 and the relative arrangement of the displaceable ring 2, pivot 8 and the pump shaft 6 may be substantially identical with the embodiment according to FIG. 4.

Figure 7:
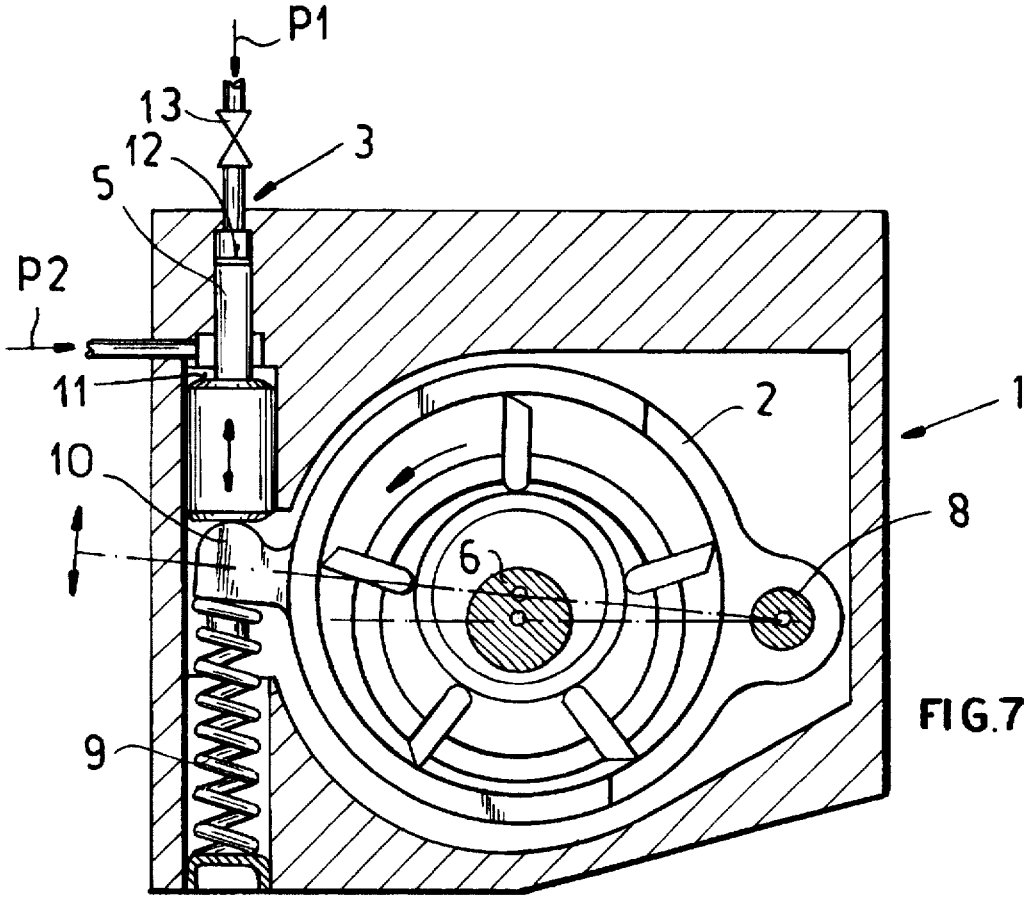
FIG. 7 is a cross sectional view which shows a vane pump comprising a stepped piston acting simultaneously as a pressure-dependent and temperature-dependent regulating element.

FIG. 7 shows a further variant of the displacement of the displaceable ring of a vane pump. In this case the pressure-dependent regulation, the temperature-dependent regulation and possibly also a speed-dependent regulation are embodied in the same regulating member 5, which, in this case, is a stepped piston. For instance an output pressure P2 of the pump act permanently onto a first sub-area 11 of the stepped piston 5, so that a maximum pressure limitation is obtained thereby. In addition a second step of the piston 5 has an area 12 onto which acts a pressure P1 which, in the simplest case, is identical to the pressure P2 and is obtained from the same source. In a supply pipe to the pressure space, from where pressure can act onto the area 12, is provided a controllable valve 13 which switches in dependence on temperature and/or revolutions. At low revolutions and/or low temperatures the valve 13 may be, for instance, open so that pressures act on both the areas 11 and 12 and thereby a greater total force acts against the spring 9 than if the pressure acted only onto the area 11. The displaceable ring and the shaft of the vane pump are so arranged that the eccentricity of the displaceable ring is reduced by a movement of the regulating member or stepped piston 5 downwards in FIG. 7. When the temperature and/or engine speed increase the valve 13 is closed, so that pressure acts only onto the area 11 and the displaceable ring is displaced by the action of the spring 9 again in the direction of greater eccentricity and thereby greater pumping capacity of the vane pump. As has already been mentioned, the valve may be arranged to be dependent not only on temperature but also on engine speed. In this way is obtained, in addition to the pure limitation of maximum pressure and regulation of the lubricant flow, an additional limitation of the lubricant flow in dependence on the temperature and/or the engine speed of the engine.

Although the design of the pump is made by the additional regulating elements a little more complex, the energy savings achievable by the pump easily compensate for this small disadvantage and furthermore, for instance, the embodiment according to. FIG. 5 shows a very simple possibility of carrying out the additional regulation according to the invention in practice.

We claim:

1. A controllable lubricant vane pump, comprising:

a housing;

a rotor rotatable in said housing about an axis and provided with pumping vanes extending from the rotor;

an eccentric ring surrounding said rotor and against which said vanes ride, said ring having on one side a pivot with an axis parallel to the axis of said rotor and on an opposite side, a projection extending from said ring;

a first spring in said housing braced against said projection and a piston in said housing bearing against said projection against a force of said first spring; and a regulating device acting upon said ring against the force of said first spring, said regulating device comprising:

a wedge linearly guided in said housing and bearing on said ring between said pivot and said projection against the force of said first spring, a second spring braced in said housing and bearing upon said wedge to urge said wedge between said housing and said ring in a direction wherein said wedge presses said ring against a force of said first spring to reduce eccentricity of said ring relative to said rotor, and a thermally sensitive element interposed between said wedge and said housing and expanding with increasing temperature to displace said wedge against a force of said second spring so that with decreasing temperature said ring is displaced about said axis of said pivot further against the force of said first spring.

* * * * *